United States Patent [19]

Panek

[11] 3,998,515

[45] Dec. 21, 1976

[54] HERMETIC ELECTRICAL PENETRATOR

[75] Inventor: George J. Panek, Phoenix, Ariz.

[73] Assignee: International Telephone and Telegraph Corporation, New York, N.Y.

[22] Filed: Sept. 25, 1975

[21] Appl. No.: 616,619

[52] U.S. Cl. ..... 339/117 P; 174/11 R; 174/151; 339/94 A; 339/192 R; 339/218 R; 339/278 M

[51] Int. Cl.[2] ..... H01R 3/04

[58] Field of Search ..... 339/117 R, 117 P, 100, 339/192 R, 278 M, 218, 94 A; 174/11 R, 151

[56] References Cited

UNITED STATES PATENTS

| | | | |
|---|---|---|---|
| 3,803,531 | 4/1974 | Sorensen | 339/94 A X |
| 3,828,118 | 8/1974 | Bushek et al. | 174/151 X |

*Primary Examiner*—Roy Lake
*Assistant Examiner*—DeWalden W. Jones
*Attorney, Agent, or Firm*—A. Donald Stolzy

[57] ABSTRACT

A hermetic electrical penetrator comprising a shell mounted in a single penetrator plate. A pair of axially spaced sealing members are sealed inside the shell defining a leak sensing chamber therebetween. One or more electrical contacts extend longitudinally through the sealing members in the shell. A sensing port in the wall of the shell communicates with the sensing chamber so that any leakage of gas through the shell can be detected by measuring the pressure differential between the inside and the outside of the shell. Preferably the sealing members are glass beads, and a porous ceramic spacer extends between the beads substantially filling the leak sensing chamber so that pressure differentials may be more easily detected.

3 Claims, 3 Drawing Figures

FIG. 1.
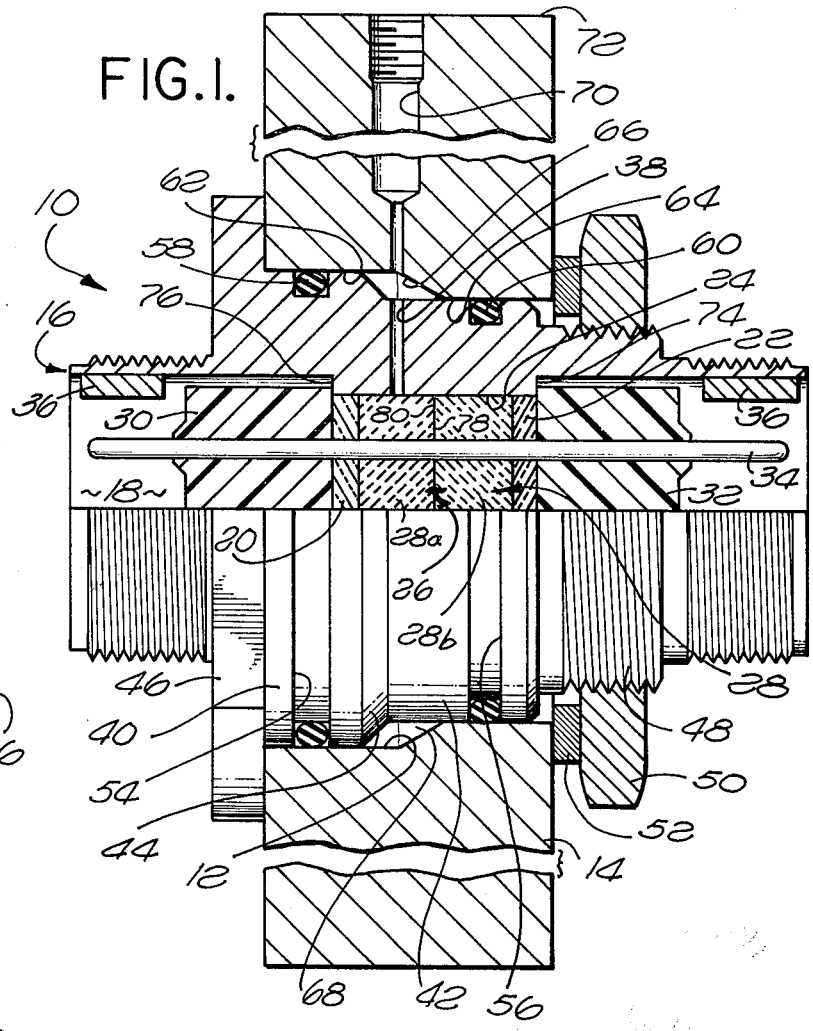
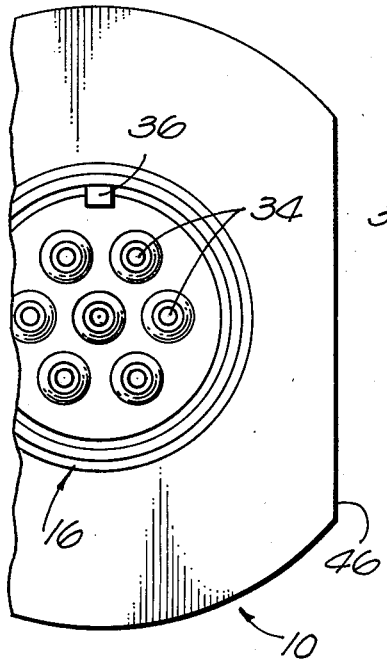
FIG. 2.
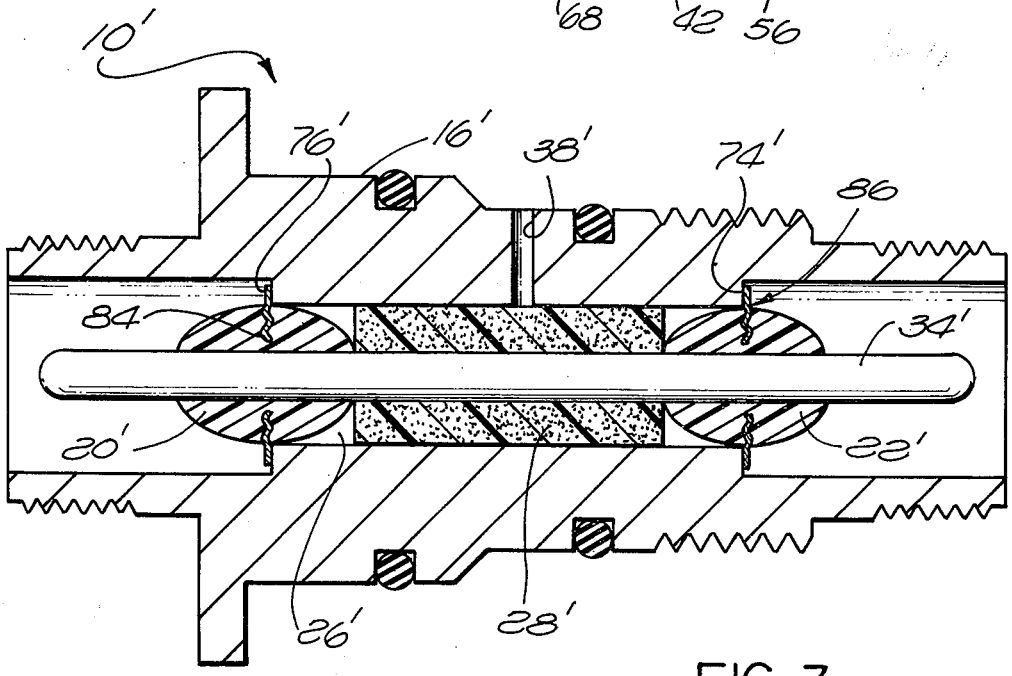
FIG. 3.

HERMETIC ELECTRICAL PENETRATOR

BACKGROUND OF THE INVENTION

The present invention relates generally to an electrical connector or penetrator and, more particularly, to a hermetic electrical penetrator for mounting in a containment wall.

Electrical penetrators used in the containment buildings of nuclear penetrators normally utilize a double seal system mounted in a canister weldment. The double seals are generally glass sealed electrical penetrators which are mounted in the end plates of the canister weldment. Due to this conventional arrangement, leak paths are built in the assembly of the components into the canister and in the canister itself. The canister is a relatively expensive structure which is somewhat costly to assemble in a containment wall. Further, the leaking of gas in the canister cannot be detected.

The purpose of the present invention is to overcome the need for the canister in an electrical penetrator by the use of an economical single electrical penetrator, which may be assembled into a single plate. Further, the present invention provides means for detecting any leaks occurring in the penetrator.

SUMMARY OF THE INVENTION

According to the principal aspect of the present invention, there is provided a hermetic electrical penetrator which may be mounted in a single plate, thus eliminating the need of a double sealed canister weldment assembly. The penetrator comprises a hollow shell in which there are sealed two axially spaced sealing members defining therebetween a leak sensing chamber. One or more electrical contacts extend lengthwise through the sealing members and are sealed therein. A leak sensing port is provided in the wall of the shell providing communication between the leak sensing chamber and the exterior of the shell. The leak port is adapted to be connected to a suitable leak detection device, such as a pressure differential measuring instrument. Thus, any leak path in the penetrator can be detected. Preferably, the sealing members are glass beads and a porous ceramic spacer substantially fills the leak sensing chamber between the glass beads to thereby minimize the volume of the chamber and thereby simplify the measurement of pressure differentials therein. Alternatively, the sealing members may be formed of a non-porous ceramic or a polymer, and the spacer therebetween may be eliminated if the sealing members are mounted close to each other on opposite sides of the leak sensing port in the penetrator shell. Thus, by the present invention, a relatively simple and inexpensive penetrator may be mounted in a single plate and the hermeticity of the sealing members therein may be conveniently determined.

BRIEF DESCRIPTION OF THE DRAWINGS

FIG. 1 is a partial longitudinal sectional view through one embodiment of the invention wherein an electrical penetrator containing a plurality of contacts is mounted in a single penetrator plate;

FIG. 2 is an elevational view of one end of the penetrator partially broken away; and FIG. 3 is a partial longitudinal sectional view through an alternative form of an electrical penetrator in accordance with the present invention.

DESCRIPTION OF THE PREFERRED EMBODIMENTS

Referring now to FIGS. 1 and 2 of the drawing in detail, there is illustrated a hermetic electrical penetrator, generally designated 10, mounted in an opening 12 extending through a single penetrator plate 14. The plate may be mounted in a containment wall, not shown.

The penetrator 10 comprises a hollow, generally cylindrical shell 16 having a bore 18 extending therethrough. Two axially spaced circular sealing members 20 and 22 are sealed at their outer periphery to an intermediate section 24 of the bore 18 having a slightly reduced diameter. The space between the sealing members defines a leak sensing chamber 26. Preferably, a porous spacer 28 extends between the sealing members and substantially completely fills the sensing chamber 26. Elastomeric interfacial sealing elements 30 and 32 are bonded to the outer surfaces of the sealing members 20 and 22.

A plurality of electrical contacts 34 extend longitudinally through the spacer 28, sealing members 20 and 22, and interfacial sealing elements 30 and 32. Seven of such contacts are illustrated in FIG. 2 by way of example only. Obviously, a larger or smaller number of contacts may be utilized. It is noted that the contact 34 is a double-ended pin contact. The opposite ends of the contact extend beyond the outer faces of the interfacial sealing elements 30 and 32, but do not extend beyond the opposite ends of the shell 16.

The opposite ends of the shell are externally threaded for coupling mating connection members, not shown, to the penetrator.

Polarizing keys 36 are formed on the wall of the bore 18 in the shell adjacent to the opposite ends of the shell for cooperation with keyways formed in the mating electrical connection members. Such other connection members would incorporate socket contacts which are aligned with the double-ended pin contacts 34 in the penetrator 10 so that the mating contacts will engage with each other when such connection members are coupled to the penetrator.

A radially extending leak sensing port 38 is provided in the wall of shell 16 between the sealing members 20 and 22. This port provides flow communication between the leak sensing chamber 26 and the exterior of the shell. The shell embodies a relatively large diameter cylindrical section 40 and a smaller diameter cylindrical section 42. An annular shoulder 44 joins the sections 40 and 42. An outwardly extending annular flange 46 is formed at the left end of the cylindrical section 40 of the shell. The opposite end of the smaller diameter section 42 of the shell is externally threaded, as indicated at 48, to receive a lock nut 50, which secures the penetrator within the opening 12 in the plate 14. Preferably, a washer 52 is interposed between the nut 50 and the plate.

Annular grooves 54 and 56 are formed in the cylindrical sections 40 and 42, respectively, of the shell. O-rings 58 and 60 are mounted in the grooves 54 and 56. The leak sensing port 38 opens at the outer surface of the smaller diameter section 42 between the O-ring 60 and the shoulder 44 on the shell.

The opening 12 in the penetrator plate 14 has a relatively large diameter section 62 and a relatively smaller diameter section 64. The section 62 of the opening is dimensioned to slidably receive the larger diameter section 40 of the shell, while the smaller section 64 of the opening is dimensioned to slidably receive the smaller diameter section 42 of the shell. The O-rings 58 and 60 sealingly engage the sections 62 and 64, respectively, of the opening 12. A generally annular shoulder 66 joins the sections 62 and 64 of the opening 12. This shoulder is axially spaced from the shoulder 44 on the shell 16 when the penetrator is fully mounted in the plate 14 so as to define a generally annular space 68 therebetween. The port 38 communicates with the space 68. A second leak sensing port 70 is formed in the plate 14 and extends from the annular space 68 to the outer surface 72 of the plate. The annular space 68, therefore, provides a manifold which assures flow communication between the ports 38 and 70 regardless of the rotational position of the penetrator 10 within the plate.

The outer end of the leak sensing port 70 in penetrator plate 14 is adapted to be connected to a suitable leak detection device, for example, a pressure differential measuring instrument, not shown. The port 70 is in flow communication with the leak sensing chamber 26 in the electrical penetrator 10 via the annular space 68 and the port 38 so that any leaks between the sealing members 20, 22, and the wall of the bore 18 in the shell, and between the sealing members and the contacts 34, can be detected by the instrument connected to the outlet of the port. Further, any leaks which might exist between the external surface of the penetrator shell and the wall of the opening 12 in the plate caused by failure of the O-ring seals 58 and 60 may also be detected. Thus, by the present invention, any leaks in the electrical penetrator 10 per se, or its mounting in the plate 14, can be detected.

Preferably, the sealing members 20 and 22 in the penetrator shell are glass beads or discs, which have a compression seal with the wall of the bore 18 of the shell and with the contacts 34. In the forming of the glass seals, it is necessary to provide the spacer 28 to support the beads. During assembly of the penetrator, the contacts are inserted into the spacer 28 and one of the glass beads, for example, bead 22. The assembly thus formed is inserted into one end of the shell, for example, the right end in FIG. 1. Each glass bead is formed with an outwardly extending annular flange, not shown, adjacent to the outwardly facing planar surface of the bead. The flange on bead 22 abuts against an annular shoulder 74 on the wall of the bore 18. Thereafter, the second glass bead 20 is inserted into the left end of the penetrator shell until its flange engages a second shoulder 76 on the interior of the shell. The shell is then disposed vertically with carbon fixtures, not shown, bearing against the top and bottom glass beads. The assembly is then placed in a furnace to fuse the beads to the shell and to the contacts 34. During the heating operation, the outer flanges on the beads disappear, thus producing a penetrator assembly as shown in FIG. 1. Thereafter, the assembly is removed from the furnace, the carbon fixtures are withdrawn from the opposite ends of the shell, and the interfacial seals 32 are inserted into the ends of the shell with an adhesive on their inner faces, which bond the elastomer seals to the glass beads.

The spacer 28 may be formed of a porous ceramic in which the interstices within the spacer provide a flow passage between the contacts 34 and the exterior of the spacer so that any leaks occurring between the contacts and glass beads can be detected at the port 38.

During the heating operation which is performed to effect the sealing of the glass beads 20, 22 to the shell and contacts, some of the glass flows into the adjacent surfaces of the ceramic spacer, thereby bonding the two parts together. Sometimes, the molten glass will also flow around a substantial portion of the contacts to impair the flow passage from the contacts to the sensing port 38 which is necessary to detect any leak occurring between the contacts and the glass beads. Further, some ceramics are only partially porous and, therefore, do not provide an open flow path between the contacts and the exterior of the spacer. Consequently, according to another feature of the invention, the ceramic spacer 28 is divided into two parts, designated 28*a* and 28*b*, which are axially displaced from each other within the shell 16. The opposing faces 78 and 80, respectively, on the parts 28*a* and 28*b* provide a radially extending planar flow path between the leak sensing port 38 and each contact, whereby leaks at the contacts may be detected. Thus, by this arrangement, the two parts 28*a* and 28*b* of the spacer may be formed of a non-porous material, since a leak path is provided between the opposed faces of the parts. The provision of the spacer between the sealing members 20 and 22 has the further advantage of reducing the volume of the leak sensing chamber 26, thereby making pressure differential measurements easier to detect.

In an alternative embodiment of the invention, the sealing members 20, 22 may be formed of non-porous ceramic, which is bonded to the shell 16 and to the contacts 34 by brazing or other suitable techniques. By utilizing ceramic sealing members, the pressure heating operation is not required as when using glass beads to form glass-to-metals seals. Hence, the spacer 28 could be eliminated, in which case, however, it would be preferred that the ceramic sealing members be mounted in very close relationship with respect to each other adjacent to opposite sides of the leak sensing port 38 so as to minimize the volume of the leak sensing chamber therebetween. Alternatively, a suitable spacer could be provided between the ceramic seals as in the embodiment illustrated in FIG. 1.

Reference is now made to FIG. 3 of the drawing, which shows still a further embodiment of an electrical penetrator in accordance with the present invention. In this embodiment, the basic structure is as previously described and like numbers primed are used to indicate like or corresponding parts. Rather than utilizing glass or ceramic sealing members, in the embodiment illustrated in FIG. 3 the penetrator 10′ incorporates polymeric sealing members 20′ and 22′ to provide a seal between a single, large power contact 34′ and the shell 16′. Annular corrugated metal flanges 84 and 86 are welded at their outer peripheries to the shoulders 76′ and 74′, respectively, on the interior of the shell. The inner regions of the flanges are embedded in the seals 20′, 22′. The seals are bonded to the flanges and the contact 34′. As in the previous embodiments, the leak sensing port 38′ is positioned between the seals 20′ and 22′ so as to be in flow communication with the leak sensing chamber 26′ between the seals. In order to reduce the volume of the chamber 26′, a porous plastic spacer 28′ is mounted in the chamber between the polymeric seals 20′, 22′. A porous ceramic spacer could be utilized in place of a porous plastic spacer. As previously noted, the spacer could be eliminated if the sealing members 20′ and 22′ are positioned sufficiently close to minimize the volume of the leak sensing chamber 26' so that pressure differential measurements could be easily made with relatively inexpensive instrumentation.

While the contacts in FIGS. 1 and 3 have been illustrated as being double-ended pin contacts, it will be appreciated that other forms of contacts could be utilized. For example, the ends of the contacts could be formed as solder pots for directly soldering to wires. Alternatively, one or both ends of the contacts could be in the form of a socket contact, for engagement with a mating pin contact in a second connection device. It will be further noted that while the drawing illustrates only a single electrical penetrator 10 mounted in the plate 14, a plurality of such penetrators could be mounted in the plate with each leak sensing port 38 associated therewith connected to a common instrument outlet port 70, so that a single instrument may be utilized to detect leaks in a plurality of electrical penetrators.

In view of the foregoing, it is seen that by the present invention there is provided a relatively simple and inexpensive hermetic electrical penetrator embodying a leak monitored double seal assembly which enables leaks to be detected in the penetrator. The penetrator can be assembled into a single plate, thus eliminating the necessity of a double sealed canister weldment assembly as is normally utilized in nuclear penetrators. It will further be appreciated that while the present invention has been described specifically in connection with an electrical penetrator for a nuclear containment wall, the penetrator could also be utilized in submarine hulls, underwater chambers, and pressure vessels with the same advantages achieved thereby.

What is claimed is:

1. A hermetic electrical penetrator comprising: a hollow shell having a bore therethrough; a pair of axially spaced sealing members in said bore sealed at their outer periphery to the wall of said bore, said spaced sealing members defining a leak sensing chamber therebetween; at least one electrical contact extending lengthwise through said sealing members, said contact being sealed in said sealing members; and a leak sensing port in said shell extending from said chamber to the exterior of said shell, said shell embodying relatively smaller and larger diameter outer cylindrical surfaces joined by a generally annular shoulder; and said port opening at said smaller diameter outer surface of said shell.

2. An electrical penetrator as set forth in claim 1 including: a pair of axially spaced annular grooves in said shell, one in said smaller diameter outer surface thereof, and the other in said larger diameter surface thereof;

resilient annular sealing elements positioned in said grooves; and said port extending radially through the wall of said shell and opening between said shoulder and said one groove.

3. An electrical penetrator as set forth in claim 2 including:

a penetrator plate having an opening therethrough receiving said shell in sealing relationship therewith;

the wall of said opening surrounding said port being spaced from said shoulder and said smaller diameter outer surface to define an annular space therebetween spaced from said sealing elements in said grooves; and a second port in said plate extending from said annular space to the exterior of said plate.

* * * * *